United States Patent [19]

Ohba

[11] Patent Number: 4,993,857

[45] Date of Patent: Feb. 19, 1991

[54] COSMETIC CONTAINER

[75] Inventor: Atsushi Ohba, Tokyo, Japan

[73] Assignee: Suzuno Kasei Co., Ltd., Tokyo, Japan

[21] Appl. No.: 496,843

[22] Filed: Mar. 22, 1990

[30] Foreign Application Priority Data

Mar. 29, 1989 [JP] Japan ..... 1-36075[U]
Aug. 9, 1989 [JP] Japan ..... 1-93524[U]

[51] Int. Cl.[5] ..... A45D 40/06
[52] U.S. Cl. ..... 401/75; 401/175
[58] Field of Search ..... 401/75, 175, 77, 76, 401/78, 68, 81

[56] References Cited

U.S. PATENT DOCUMENTS 1,520,430 12/1924 Noble ..... 401/75
2,383,726 8/1945 Leshin ..... 401/75
2,815,123 12/1957 Safianoff ..... 401/75

*Primary Examiner*—Richard J. Johnson
*Attorney, Agent, or Firm*—Jordan and Hamburg

[57] ABSTRACT

A cosmetic container for containing a bar-shaped cosmetic material, wherein a helical body is provided having on the top hereof a portion to which the bar-shaped cosmetic material is attached, said helical body being contained in a guide cylinder so that it does not rotate but only freely slides in the axial direction, and wherein a rotary rod having sliders slidably engaging with the helical groove of said helical body is coaxially placed within said helical body and provided so that it does not axially travel relative to said guide cylinder, whereby a feed motion is applied by rotation of the rotary rod on the helical body through the sliders to upwardly and downwardly move the cosmetic material along the inner periphery of the guide cylinder.

24 Claims, 5 Drawing Sheets

COSMETIC CONTAINER

BACKGROUND OF THE INVENTION AND RELATED ART STATEMENT

This invention relates to a container for a cosmetic material, and specifically to an improvement of a container for containing a bar-shaped cosmetic material such as a lipstick or an eyeliner.

In general, a feed mechanism is provided inside the container for a lipstick or the like, and the cosmetic material is fed out along the inner periphery of a guide cylinder when the container is rotated. Since a helical thread is used as the feed mechanism in the container, there are two types: a type wherein the cosmetic material is fed out by rotation of the container while it is rotating within the guide cylinder, and a type wherein the cosmetic material is fed out straightly without its relative rotation to the guide cylinder.

In the type wherein the cosmetic material is fed out while it is rotating, the outer periphery of the cosmetic material can be damaged if no gap is provided at the inner periphery of the guide cylinder, and therefore, for attaching the cosmetic material to the container, a method of solidifying the cosmetic material after it is directly filled in the container can not be employed.

Accordingly, the method of directly filling a fluid cosmetic material in a container and solidifying it in the container deals with a container of a structure in which the cosmetic material does not rotate relative to the guide cylinder. Of course, since this type also allows the attaching of a cosmetic material which was previously solidified in the shape of a bar, it is increasingly used for recent cosmetic containers.

These cosmetic containers have a helical thread directly formed in the inner periphery of the container main body, and in plastic containers, they are integrally formed by molding a synthetic resin. However, with the structure in which such helical thread for feeding out the cosmetic material is formed integrally with the container main body, the metal mold for molding the synthetic resin becomes very complex, and the manufacturing cost also becomes very expensive.

Additionally, if the container main body is formed of a light metal or the like rather than a plastic, it is difficult to form a helical thread in the inner periphery thereof, and if the helical thread is formed as a separate member and built in, the assembly of these is a cumbersome task and the productivity is also remarkably reduced.

OBJECTS AND SUMMARY OF THE INVENTION

It is an object of this invention to provide a cosmetic container which is very easy to manufacture or assemble, and has less expensive manufacturing cost and excellent productivity.

It is a further object of this invention to provide a cosmetic container which allows the cosmetic material to be fed out smoothly and has few failures.

For that, the cosmetic container of this invention is provided with a helical body which has on its top end a portion to which the cosmetic material is attached. The helical body is inserted into a guide cylinder for sliding only in the axial direction without rotation. A rotary rod having sliders engaged with the helical groove of the helical body is coaxially placed within the helical body, and engaged so that it does not axially move relative to the guide cylinder.

When the rotary rod is rotated, a feed motion is applied to the helical body engaged with the helical groove through the sliders, whereby the helical body having attached to it the cosmetic material travels upwardly and downwardly along the guide cylinder.

The rotary rod is coupled with an outer cylinder placed for rotation outside the guide cylinder at the bottom thereof, and rotates integrally with the outer cylinder.

The helical body consists of a helical ring around which a wire is wound with a predetermined pitch, and reinforcing ribs which are axially disposed on both sides of the helical ring for connecting between each ring.

Since the helical groove between the helical rings is formed as a gap penetrating from the inner to the outer side, for forming the helical body by molding, it is not required to use a loose piece to be drawn out in the direction of center axis of the helical body while it is rotated, but the helical body can be molded using a split-cavity mold which is divided to left and right centering around the axis center. For this, the axial length of the helical body can freely be set, and the manufacture of the metal mold also becomes easy, whereby the improvement of the productivity and the reduction of the manufacturing cost can be achieved.

The cross-sectional shape of the helical rings is trapezoidal, and the cross-sectional shape of the sliders engaging with the helical groove formed between the rings is also formed in a trapezoid. By engagement of such trapezoidal cross sections, they are not disengaged even if a thrust force is applied between the rotary rod and the helical body.

The sliders slidably engaged with the helical groove of the helical body is formed substantially in the shape of a diamond, assuring smooth sliding property.

The characteristic construction of this invention will be further clarified by the following embodiment.

DETAILED DESCRIPTION OF PREFERRED EMBODIMENT

Figure 1:
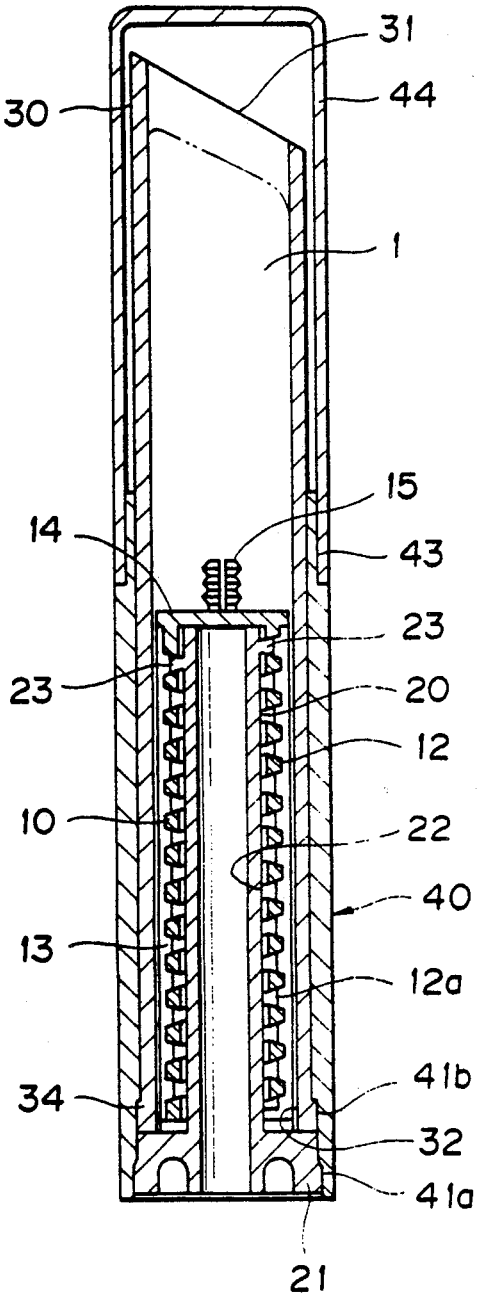
FIG. 1 is a cross-sectional view showing the whole cosmetic container of this invention.
Figure 2:
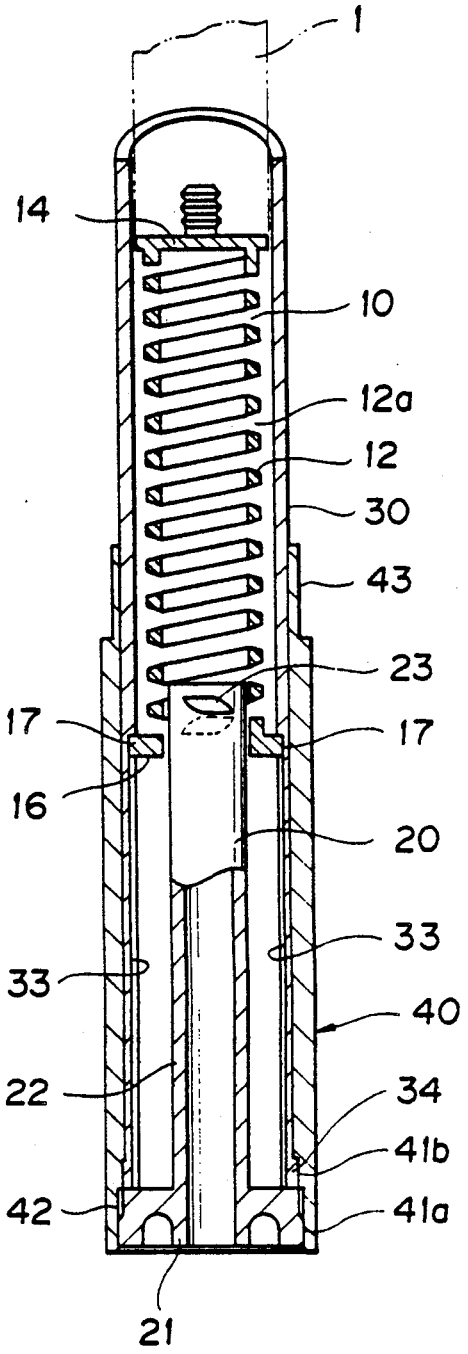
FIG. 2 is a cross-sectional view showing the state wherein the cosmetic material has been fed out.

The cosmetic container of this invention comprises, as shown in FIG. 1 and 2, a helical body 10 to which a cosmetic material 1 is attached, a rotary rod 20 for moving the helical body 10, a guide cylinder 30 for slidably guiding the helical body 10, and an outer cylinder 40 placed outside the guide cylinder 30.

Figure 3:
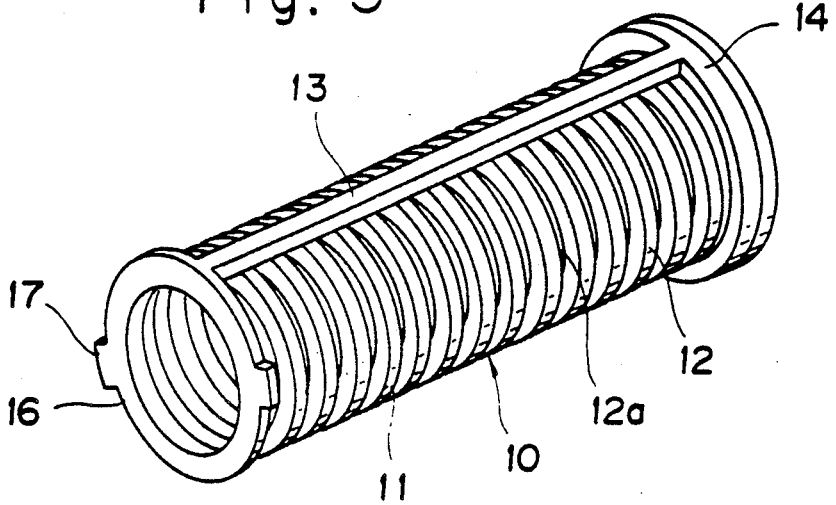
FIG. 3 is a perspective view of the helical body.
Figure 4:
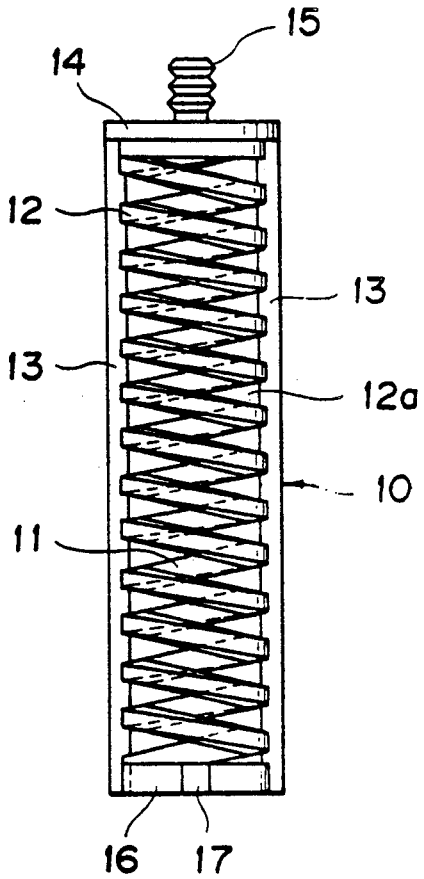
FIG. 4 is a side view of FIG. 3.
Figure 5:
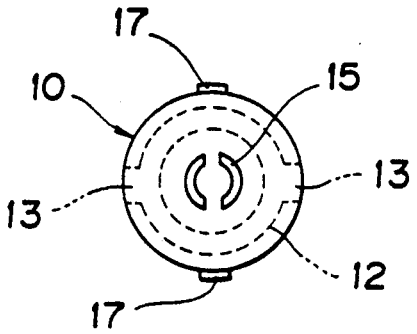
FIG. 5 is a plan view of the upper portion of the helical body.

In the helical body 10, as shown in FIG. 3 to 5, a section 11 of trapezoidal cross section is formed with a predetermined diameter and a predetermined pitch to form a helical ring 12, and each section 11 is integrally connected to a pair of reinforcing ribs 13 axially extending on both sides of the helical ring 12. By this, the deformation of the spacing between the sections of the helical ring 12, or of the spacing between the helical groove 12*a* is prevented.

Figure 6:
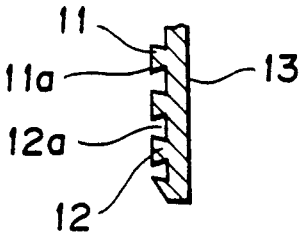
FIG. 6 is a cross-sectional view showing part of the helical body.

As shown in FIG. 6, the cross section of the wire 11 is formed in the shape of a trapezoid so that the axial spacing of the helical groove 12*a* of the helical ring 12 is larger at the inner periphery than at the outer periphery. Also, the corner portions of the sections 11 form an acute angle and no circular plane is provided.

A tray portion 14 is provided in the upper surface of the helical body 10 for attaching the cosmetic material 1, and a cosmetic material holder 15 is formed in the center of the tray portion 14. This is used for holding the helical body 10 within the guide cylinder 30 at the lowest fall position and the fluid cosmetic material 1 is filled from above and solidified.

In the circumference of a ring 16 on the underside of the helical body 10, a pair of projections 17 are formed at the positions perpendicular to the reinforcing ribs 13, and as described later, the projections 17 are slidably engaged with the guide grooves 33 of the guide cylinder 30.

The helical body 10 is preferably formed by molding a synthetic resin, and at this time, a split-cavity mold is used which is divided so that a parting line is formed along the reinforcing ribs 13 of the helical body 10. In the use of a cosmetic container having a helical groove formed on the inner periphery thereof, such as a conventional helical cylinder, a loose piece using a screw drawing mechanism is required for molding, but the helical body 10 of this invention is constructed of the helical ring 12 and the helical groove 12*a* being formed as a gap penetrating from the inner to the outer side, so a loose piece need not be used which is drawn out while it is rotated in the center axis direction of the helical body 10, and the molding can be performed using a split-cavity mold which is the left and right centering around the axis center. For this, the axial length of the helical body 10 can freely be set, and the manufacture of the metal mold becomes easy, whereby the improvement of the productivity and the reduction of the manufacturing cost can be achieved.

Figure 7:
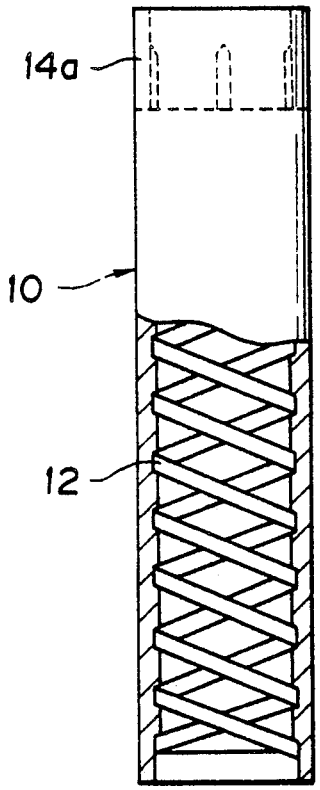
FIG. 7 is a side view of an embodiment with a different helical body.

As the tray portion 14 provided in the upper surface of the helical body 10, a deep cylindrical tray portion 14*a* may be provided as shown in FIG. 7. This is used for inserting and mounting the cosmetic material 1 which was previously solidified.

Figure 8:
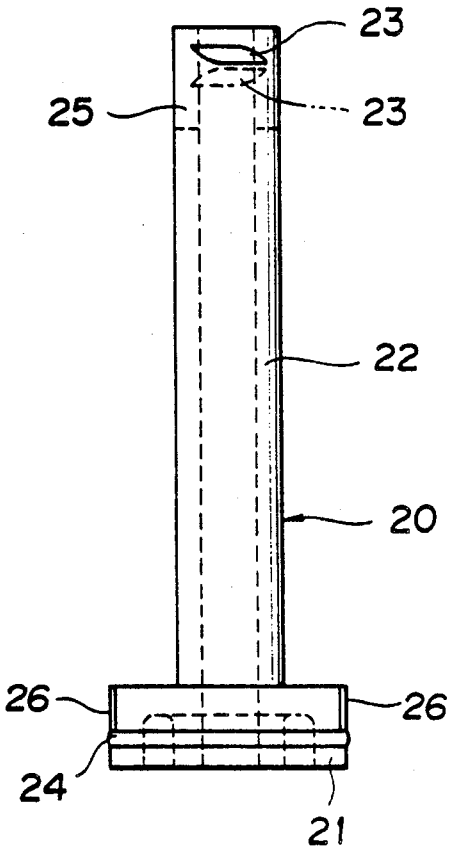
FIG. 8 is a front view of the rotary rod.
Figure 9:
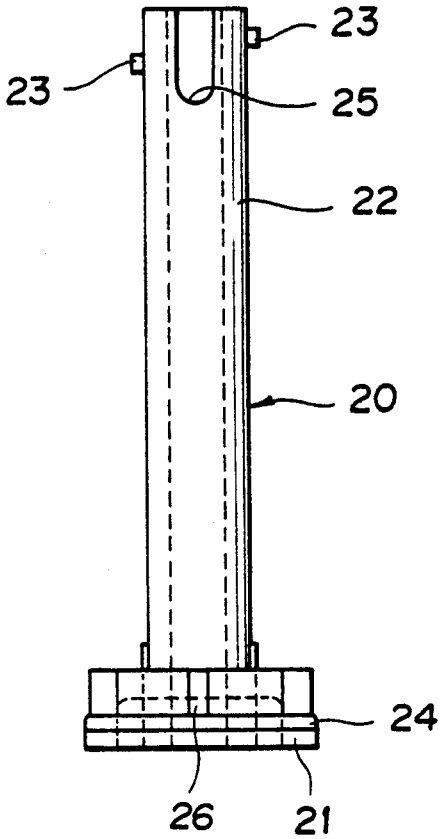
FIG. 9 is a side view of FIG. 8.
Figure 10:
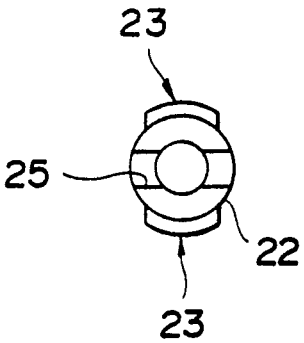
FIG. 10 is a plan view of FIG. 8.

The rotary rod 20 placed within the helical body 10 consists of a hollow strut 22 which is provided with a flange portion 21 on the bottom thereof, as shown in FIGS. 8 to 10.

Figure 11:
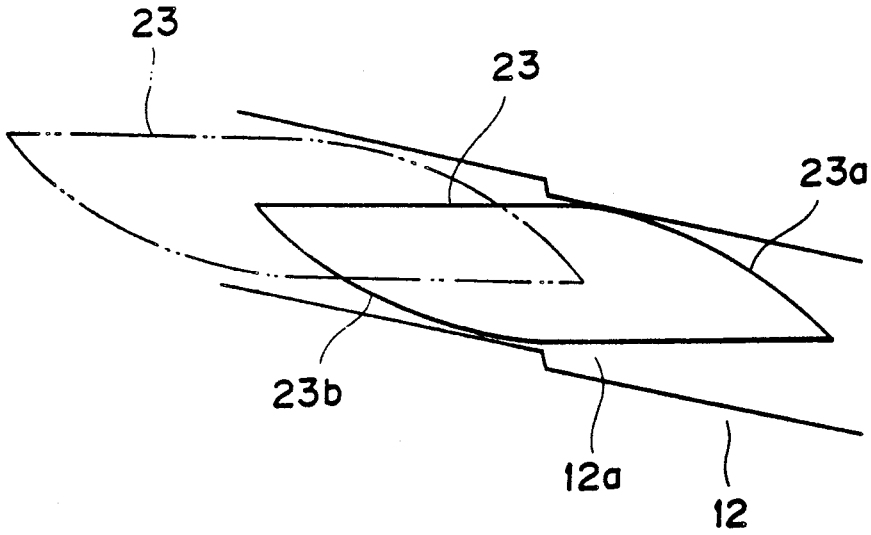
FIG. 11 is an enlarged view of the sliders.

On both surfaces of the upper portion of the strut 22, a pair of sliders 23 are projectively provided which are engaged with the helical groove 12*a* of the helical body 10. The sliders 23 are formed substantially in the form of a diamond, the upper and lower surface of which as curved surfaces 23*a* and 23*b*, respectively, as enlarged in FIG. 11, so that they can smoothly get over the very small steps along the parting line by the split-cavity mold which is formed in the helical ring 12 at the time of molding. In addition, the positions of the pair of sliders 23 are displaced with respect to each other in the upward and downward directions correspondingly to the pitch of the helical ring 12.

the cross section of the sliders 23 is formed in an anti-trapezoidal cross section in conformity with the trapezoidal cross section of the helical ring 12 as shown in FIG. 1. Thus, the engaging portions are both trapezoidal and the corner portions at an acute angle, so the sliders 23 are effectively prevented from slipping out from the helical groove 12*a* even if an axial thrust force acts between the helical body 10 and the rotary rod 20.

In the upper portion of the hollow strut 22, a pair of notches 25 are formed between each slider 23, whereby when the sliders 23 are engaged with the helical groove 12*a* from the inside of the helical body 10, that portion elastically deforms to the inside for facilitating diameter reduction.

On the outer periphery of the circular flange portion 21, an annular step portion 24 is formed, and a pair of axially extending projection portions 26 are formed.

The guide cylinder 30 into which the helical body 10 is inserted has an obliquely cut opening 31 formed on the top thereof, as shown in FIGS. 1 and 2, when it is used as the container of a lipstick as in this embodiment, and the rotary rod 20 is inserted along with the helical body 10 through an opening 32 in the bottom thereof.

In order to prevent the helical body 10 from rotating in the guide cylinder 30, a pair of guide groove 33 axially extending from the bottom of the guide cylinder 30 is formed in the inner periphery thereof correspondingly to the projections 17 of the helical body 10. The length of the guide grooves 33 is set so as to match the axial effective length of the helical ring 12, and this is the effective travel amount of the helical body 10. And, the axial length of the guide cylinder 30 is set to at least two times the helical body 10, so whatever the position the helical body 10, the tray portion in the top thereof never projects from the upper opening 31 of the guide cylinder 30.

The outer diameter of the guide cylinder 30 was previously made to coincide with the outer diameter of the flange portion 21 of the rotary rod 20, and thus the guide cylinder 30 abuts on the upper surface of the flange portion 21, thereby preventing the axial relative displacement. The outer cylinder 40 is placed outside the guide cylinder 30 for relative rotation, and the axial length of the outer cylinder 40 is set at least longer than the axial length of the helical body 10, so that the helical body 10 hides inside at its most retraced position if the guide cylinder 30 is formed of a transparent member.

In the inner periphery of the lower portion of the outer cylinder 40, a first expanded diameter portion 41*a* is formed which fits over the step portion 24 formed on the outer periphery of the flange portion 21 of the rotary rod 20, and in a portion deeper than this, a second expanded diameter portion 41*b* of a smaller diameter is formed.

The second expanded diameter portion 41*b* engages with the step portion 34 formed on the outer periphery of the lower portion of the guide cylinder 30, thereby to hold the guide cylinder 30 so that it does not upwardly slip out relative to the outer cylinder 40.

In the inner periphery of the first expanded diameter portion 41*a*, a pair of vertical grooves 42 engaging with the projecting portions 26 of the flange 21 is formed, whereby the outer cylinder 40 is engaged with the flange portion 21 of the rotary rod 20 so that it cannot rotate, thereby enabling the outer cylinder 40 and the rotary rod 20 to integrally rotate relative to the guide cylinder 20.

The upper portion of the outer cylinder 40 is formed with a step portion 43 of a small diameter, over which a cap 44 for covering the guide cylinder 30 and the cosmetic material 1 therein is removably fitted. The outer diameter of the cap 44 is made to coincide with the outer diameter of the outer cylinder 40.

With this arrangement, to feed out the cosmetic material 1, grasp the guide cylinder 30 and rotate the outer cylinder 40, then the rotary rod 20 rotates together and rotates relative to the helical body 10 which never rotates within the guide cylinder 30.

Since the sliders 23 of the rotary rod 20 relatively travel along the helical groove 12*a* of the helical body 10, an axial feed motion is applied on the helical body 10, and the helical body 10 is fed out straight upwardly without rotation while the projections 17 slide along the guide grooves 33.

Therefore, the cosmetic material 1 also rises without rotating in he inner periphery of the guide cylinder 30. By this, the cosmetic material is fed out.

To contain the cosmetic material 1 in the container, it is only needed to rotate the outer cylinder 40 relative to the guide cylinder 30 in the direction opposite to the above. By this, a feed motion in the downward direction is applied on the helical body 10, and the cosmetic material 1 is contained in the container.

Since the curved surfaces 23*a* and 23*b* of the sliders 23 smoothly get over the steps of the parting line of the helical groove 12*a* during the travelling of the helical body 10, the travelling is performed smoothly, and stable and smooth feeding-out and containing operations are insured.

In addition, since the cross sections of the sliders 23 and the engaging cross section of the helical groove 12*a* constitute trapezoidal cross sections which are closely contacted with each other, disengagement does not easily occur between the helical body 10 and the rotary rod 20 even if a strong axial thrust force is applied between the helical body 10 and the rotary rod 20, exhibiting high durability.

The assembly of this container can easily be done as described below.

The helical body 10, the rotary rod 20, the guide cylinder 30 and the outer cylinder 40 are previously formed by molding of a synthetic resin, respectively. First the rotary rod 20 is inserted into the helical body 10. This insertion can easily be performed by deforming the sliders 23 inwardly using the notches 25 in the top end. After incorporating the rotary rod 20 into the helical body 10, the helical body 10 is inserted from the bottom of the guide cylinder 30 so that the projections 17 engage with the guide grooves 33.

Then, the guide cylinder 30 is inserted from the bottom of the outer cylinder 40 until the step portion 45 abuts on the second expanded diameter portion 41*b*, and simultaneously the step portion 24 is fitted in the first expanded diameter portion 41*a* while the projecting portions 26 provided in the flange portion 21 of the rotary rod 20 are engaged with the vertical grooves 42 of the outer cylinder 40, thereby integrating the rotary rod 20 and the outer cylinder 40.

At this point, the circumferential upper surface of the flange portion 21 of the rotary rod 20 abuts from the bottom of the guide cylinder 30, and the step portion 34 of the guide cylinder 30 engages with the first expanded diameter portion 41 of the outer cylinder 40, whereby the axial relative movement of the guide cylinder 30 against the rotary rod 20 and the outer cylinder 40 is suppressed.

Accordingly, by sequentially combining the helical body 10, the rotary rod 20, the guide cylinder 30 and the outer cylinder 40 in this way, a cosmetic container can easily be assembled.

This invention is not necessarily be restricted to the above description, and various modifications made in the scope of the technical idea of this invention are included in this invention. For instance, as the above-mentioned helical body may be the one in which a helical groove is formed in the inner periphery of a cylindrical body.

I claim:

1. A cosmetic container for a cosmetic material comprising a helical body having a top end portion on which said cosmetic material is disposed, a hollow guide cylinder means in which said helical body is disposed, said helical body comprising a plurality of helical rings separated by said helical groove, a rotary rod coaxially disposed within said helical body, said rotary rod being rotatable relative to said guide cylinder, said rotary rod having slider means engaging said helical groove such that rotation of said rotary rod effects axial displacement of said helical body relative to said rotary rod.

2. A cosmetic container according to claim 1, said helical body comprising axially extending reinforcing rib means joined to said plurality of helical rings and axially traversing said helical groove to thereby interconnect said helical rings.

3. A cosmetic container according to claim 2, wherein reinforcing rib means comprises two ribs spaced 180 degrees apart.

4. A cosmetic container according to claim 2, wherein said helical rings and said reinforcing rib means are integrally formed in a split mold.

5. A cosmetic container according to claim 2, wherein said reinforcing rib means are disposed radially outwardly of said helical groove.

6. A cosmetic container according to claim 1, wherein said helical groove has a generally trapezoidal cross-sectional configuration along an axial cutting plane.

7. A cosmetic container according to claim 1, wherein said slider means comprise projecting means extending generally radially outwardly of said rotary rod, said projection means having a generally trapezoidal cross-sectional configuration along an axial cutting plane.

8. A cosmetic container according to claim 7, wherein said projection means have a generally overall parallelogrammatic cross-sectional configuration with one pair of opposite sides being generally linear and with the other pair of opposite sides being arcuate.

9. A cosmetic container according to claim 1, wherein said helical body is a molded synthetic resin body formed in a split-cavity mold which is divided along an axial plane.

10. A cosmetic container according to claim 1, wherein said rotary rod has an end portion having an outer cylindrical surface from which said slider means project, said end portion having a hollow interior, axial groove means in said end portion disposed to enable temporary deformation of said end portion to thereby temporarily reduce the diameter of said outer cylinder surface to thereby facilitate insertion of said slider means within said helical groove during assembly of the cosmetic container.

11. A cosmetic container according to claim 10, wherein said slider means comprises two projections spaced 180 degrees apart, said axial groove means comprising two axial grooves spaced 180 degrees apart, said projections being disposed circumferentially between said axial grooves.

12. A cosmetic container according to claim 1, wherein said slider means comprise two projections spaced 180 degrees apart, one of said projections being axially spaced from the other projection by a distance substantially equal to the pitch of said helical groove.

13. A cosmetic container according to claim 1, wherein said top end of said helical body has means for attaching said cosmetic material.

14. A cosmetic container according to claim 1, wherein said helical body has first engagement means and said guide cylinder means has second engagement means engageable with said first engagement means to preclude relative rotation between said helical body and said guide cylinder means.

15. A cosmetic container according to claim 14, wherein one of said first and second engagement means comprises a radial projection and the other of said first and second engagement means comprises an axial groove in which said radial projection slides.

16. A cosmetic container according to claim 15, wherein said radial projection is on said helical body and said axial groove is on said guide cylinder means.

17. A cosmetic container according to claim 1 further comprising an outer cylinder means rotatably disposed externally of said guide cylinder means, said rotary rod means having a flange portion, and connecting means on said flange portion and on said outer cylinder for connecting said flange to said outer cylinder.

18. A cosmetic container according to claim 17, wherein said connecting means comprises axially extending grooves in said outer cylinder and axially extending projections on said flange portion, said projections being disposed in said grooves.

19. A cosmetic container according to claim 1, wherein said helical body has a top end and a bottom end, said helical body comprising a helical member extending helically from said top to said bottom end, said helical member comprising a plurality of 180 degree helical rings, each of said rings being spaced from one another by said helical groove.

20. A cosmetic container for a cosmetic material comprising a helical body having a top end portion on which said cosmetic material is disposed, a hollow guide cylinder means in which said helical body is disposed, said helical body comprising a helically extending member having a plurality of 180 degree helical ring sections, each of said ring sections being separated from one another by a helical groove, a rotary rod coaxially disposed within said helical body, said rotary rod being rotatable relative to said guide cylinder, said rotary rod having slider means engaging said helical groove such that rotation of said rotary rod effects axial displacement of said helical body relative to said rotary rod.

21. A cosmetic container according to claim 20, wherein each of said ring sections has an inner ring surface and an outer ring surface, said inner ring surface of each ring section being disposed on an inner cylindrical surface, said outer ring surface of each ring section being disposed on an outer cylindrical surface, said groove extending between said inner and outer cylindrical surfaces.

22. A cosmetic container according to claim 20, wherein said helical body has a top end ring part and a bottom end ring part, said helical body having a central longitudinal axis, said top end ring part and said bottom end ring part each extending generally perpendicular to said axis, said helical body further comprising spaced longitudinal ribs joined to and extending between said top ring part and said bottom ring part and also joined to said outer ring surface of each of said ring sections.

23. A cosmetic container according to claim 20, wherein said top portion of said helical body comprises a cylindrical tray which receives said cosmetic tray.

24. A cosmetic container according to claim 23, wherein said cylindrical tray has spaced elongated slots.

* * * * *